US006901935B2

(12) United States Patent
Chang

(10) Patent No.: US 6,901,935 B2
(45) Date of Patent: Jun. 7, 2005

(54) DEVICE FOR REMOVING ARTIFICIAL FINGERNAILS AND FINGERNAIL POLISH

(75) Inventor: Yong Jin Chang, Manhasset, NY (US)

(73) Assignee: Kiss Products, Inc., Port Washington, NY (US)

( * ) Notice: Subject to any disclaimer, the term of this patent is extended or adjusted under 35 U.S.C. 154(b) by 138 days.

(21) Appl. No.: 10/299,151

(22) Filed: Nov. 19, 2002

(65) Prior Publication Data

US 2004/0094177 A1 May 20, 2004

(51) Int. Cl.[7] ..... A45D 29/20; A45D 29/18; A45D 29/00

(52) U.S. Cl. ..... 132/75; 132/73.5; 132/73

(58) Field of Search ..... 132/74.5, 75, 73.5, 132/76.5; 15/104.92, 167.3; 401/122; 215/383, 384, 382, 6; 220/755, 23.83; 222/94

(56) References Cited

U.S. PATENT DOCUMENTS

| | | | | | |
|---|---|---|---|---|---|
| 26,629 | A | | 12/1859 | Thomson | |
| 1,374,851 | A | | 4/1921 | Hirth | |
| 1,750,451 | A | | 3/1930 | Wrightson et al. | |
| 2,026,449 | A | * | 12/1935 | Ward | 215/6 |
| 2,245,929 | A | | 6/1941 | Mangold | |
| D155,435 | S | | 10/1949 | Mangold | |
| 2,580,981 | A | | 1/1952 | Webster | |
| 2,629,124 | A | | 2/1953 | Merritt | |
| 2,703,422 | A | | 3/1955 | Roosa | |
| 2,713,693 | A | | 7/1955 | Johnson | |
| 3,316,922 | A | | 5/1967 | Seldler | |
| 3,859,671 | A | * | 1/1975 | Tomasello | 4/144.1 |
| 4,022,228 | A | | 5/1977 | Ropp et al. | |
| 4,180,884 | A | | 1/1980 | Hess et al. | |
| 4,255,826 | A | | 3/1981 | Boyd | |
| 4,319,596 | A | | 3/1982 | Jackson | |
| 4,321,936 | A | | 3/1982 | Chaconas | |
| 4,397,324 | A | | 8/1983 | Thomas, Jr. | |
| 4,476,883 | A | | 10/1984 | Diaz | |
| 4,510,954 | A | | 4/1985 | Miller | |
| 4,819,672 | A | | 4/1989 | Walker et al. | |
| 5,007,441 | A | | 4/1991 | Goldstein | |
| 5,048,547 | A | | 9/1991 | Walker | |
| 5,054,503 | A | | 10/1991 | Keller | |
| 5,065,778 | A | | 11/1991 | Terrell | |
| 5,379,474 | A | | 1/1995 | Nakamura | |
| 5,388,597 | A | | 2/1995 | Smith et al. | |
| 5,609,166 | A | | 3/1997 | Walker | |
| 5,613,506 | A | | 3/1997 | Kurokawa | |
| 5,753,289 | A | * | 5/1998 | Ness | 426/394 |
| 5,779,102 | A | * | 7/1998 | Smith | 222/144.5 |
| 5,782,384 | A | * | 7/1998 | Mejia Mustafa et al. | 222/94 |
| 5,806,536 | A | | 9/1998 | Tietjen | |
| 5,810,021 | A | | 9/1998 | Walker | |
| 5,823,203 | A | | 10/1998 | Carroll et al. | |
| 5,850,953 | A | * | 12/1998 | Dallas, Jr. | 222/571 |
| 5,855,212 | A | | 1/1999 | Walker | |
| 6,116,248 | A | | 9/2000 | Walker | |
| 6,311,863 | B1 | * | 11/2001 | Fleming | 220/713 |

* cited by examiner

*Primary Examiner*—John J. Wilson
*Assistant Examiner*—Robyn Doan
(74) *Attorney, Agent, or Firm*—Hoffmann & Baron, LLP

(57) ABSTRACT

An artificial nail and polish remover includes a container for holding a quantity of solvent. The container defines a top opening, a semi-circular receptacle communicating with the top opening and a circular receptacle communicating with the top opening. The semi-circular receptacle is sized and shaped for simultaneous insertion therein of all the fore-fingers of a hand and the circular receptacle is positioned adjacent the semi-circular receptacle for insertion therein of the thumb. The container includes two indents which extend inwardly into the container for providing a secure finger grip to the container. The remover further includes a strip brush member fixedly coiled around the inside perimeter of the semi-circular receptacle and a tubular brush fixed within the circular receptacle. The remover further includes an insert fitted within the container.

20 Claims, 8 Drawing Sheets

DEVICE FOR REMOVING ARTIFICIAL FINGERNAILS AND FINGERNAIL POLISH

BACKGROUND OF THE INVENTION

The present invention relates generally to fingernail cleaning devices and, more particularly, to an apparatus for removing artificial nails and/or fingernail polish from the natural fingernails.

Fingernail polish and artificial nails have been used for many years to enhance the cosmetic appearance of the fingers. Some individuals choose to use artificial nails because their own nails are too weak to grow to a desirable length without breaking. Others select artificial nails because they are considerably stronger and more durable than natural nails, and because nail polish adheres better to the artificial nail surface. Some individuals are unhappy with the shape and contour of their natural nail and prefer using an artificial nail to improve the appearance of their nails.

It has been known in the art of adorning the hands to provide ornamental fingernail accessories made from thin, molded plastic members manufactured generally in the shape of a fingernail. Indeed, numerous artificial fingernail manufacturers have provided a variety of combinations of materials, arrangements, and colors in fingernail accessories. With the advent of such artificial fingernail accessories, the wearer could now have intricately pre-designed fingernails that are simply attached to the natural fingernail and then later removed. Artificial nails are affixed to the natural nails by various techniques, virtually all of which require at least one layer, and typically multiple layers, of a glue, especially a permanent cyanoacrylate glue. Each application of permanent glue may also be accompanied by the application of powder and gel compounds for cosmetic purposes.

The result, especially when one considers that an artificial nail is often painstakingly administered to, strengthened and re-strengthened periodically, for example, at weekly appointments at a nail salon, is an artificial nail whose attachment to the natural nail is so secure that it is not uncommon for one desiring to remove the artificial nails to have to soak the nails in a solvent for time periods on the order of one hour. Even then, the wraps, the glue and the other remnants of the artificial nail and its attachment typically have to be physically peeled or scraped off the natural nail, thereby making the entire procedure laborious, time-consuming and uncomfortable.

Acetone is generally used as the solvent for dissolving artificial fingernails and fingernail polish. Some acetone formulations also contain materials intended to protect and condition the skin of the wearer's fingers. However, acetone is a volatile material and evaporates quickly, producing gaseous compounds that may irritate the throat, lungs and eyes of exposed individuals. Furthermore, the acetone may damage adjacent furniture, carpet and other objects if it is spilled or splashed onto these surfaces.

Various solvent containing devices have been developed in the prior art to facilitate the removal of fingernail polish and artificial fingernails, and especially to reduce the hazards associated with the use of strong solvents to remove the fingernail polish and artificial fingernails. Exemplary of such devices are those described in U.S. Pat. Nos. 6,116,248, 5,855,212, 5,823,203, 5,810,021, 5,806,536, 5,609,166, 5,379,474, 5,048,547, 4,819,672, 4,180,884, 2,580,981, 2,245,929 and 1,374,851. Many of these prior art devices utilize covers or slitted diaphragms, etc., to minimize spillage and evaporation of the solvent and to minimize exposure of the manicurist or wearer to the solvent. Other devices include sponges, brushes or other scuffing materials to hasten softening and removal of the fingernail polish and/or artificial fingernails. As the fingernail comes into contact with the sponge or brush, the cleaning solvent, such as acetone, will dissolve the nail polish or artificial nail adhesive and the friction between the sponge or brush and the fingernail during the insertion, withdrawal, or other movement of the finger will remove at least a predominant part of the nail polish or artificial nail.

Most prior art devices enable only one finger at a time to be treated for removing the fingernail polish and/or artificial fingernails, whereby the process of removing fingernail polish and artificial fingernails from all ten fingers is very time consuming. Some devices, however, include multiple apertures so that more than one finger can be treated simultaneously. Many of these devices, and especially those which permit simultaneous treatment of multiple fingers, are relatively complex and expensive in construction, and/or have fixed positions for inserting the fingers so that they are not always suitable or comfortable for use by all persons.

Accordingly, it is an object of the present invention to provide an apparatus and system for removing fingernail polish and artificial fingernails simultaneously or individually from the fingers, which is simple and inexpensive in its construction, and which may be easily and comfortably used to remove fingernail polish and artificial fingernails from a wide range of different size hands.

SUMMARY OF THE INVENTION

The present invention is an artificial nail and polish remover including a container having a bottom, a continuous side wall and a top. The container defines a semi-circular receptacle opening at the top and a circular receptacle opening at the top. The semi-circular receptacle is sized and shaped for simultaneous insertion therein of the fore-fingers of a hand and the circular receptacle is positioned adjacent the semi-circular receptacle whereby the thumb of a user of the remover can be inserted simultaneously with the fore-fingers. Preferably, the semi-circular receptacle is in fluid communication with the circular receptacle.

In a preferred embodiment, the side wall of the container includes two depressions formed therein, whereby a secure grip can be made of the container by the non-inserted hand of the user. The depressions preferably extend inwardly into the container, thereby partially defining the semi-circular receptacle and the circular receptacle.

Preferably, the artificial nail and polish remover of the present invention further includes a strip brush member having a plurality of bristles and a tubular brush having a plurality of bristles. The strip brush member is fixed around an inside perimeter wall of the semi-circular receptacle, whereby the bristles project inwardly into the semi-circular receptacle for scuffing the nails of the fore-fingers. The tubular brush is fixed within the circular receptacle, whereby the bristles project inwardly into the circular receptacle for scuffing the thumbnail. The strip brush member preferably includes a front face and a back face. The bristles project from the front face and the back face has at least one groove formed thereon. The groove engages with a projection formed on the inside perimeter wall of the semi-circular receptacle, whereby the strip brush member is fixed against movement during scuffing. The tubular brush is preferably a cylinder having a wall with a plurality of slits formed therethrough. Thus, solvent flows into and out of the interior of the tubular brush.

In a preferred embodiment, the artificial nail and polish remover further includes an insert fitted into the container. The insert has a tubular portion, a finger support portion and a shoulder portion. The tubular portion includes a cylindrical bore defining the circular receptacle and the finger support portion, along with the continuous side wall of the container, defines the semi-circular receptacle. The finger support portion is preferably separated from the tubular portion by two insert depressions, which correspond in shape to the depressions formed in the container. The shoulder portion connects the tubular portion and the finger support portion and rests on the container depressions.

In the preferred embodiment including the insert, the tubular brush is fixed within the cylindrical bore of the insert. The back face of the strip brush member then preferably includes at least one notch and/or at least one projection formed thereon. The notch and/or projection engages a respective projection and/or groove formed on the finger support portion of the insert for fixing the strip brush member in the semi-circular receptacle during scuffing. Preferably, the strip brush member includes two sets of bristles projecting the front face and a central portion separating the two sets of bristles. The back face of the strip brush member adjacent the central portion is positioned against the finger support portion of the insert. The bristles extend in substantially parallel rows from the central portion outwardly to opposite ends of the strip brush member. At least the first row of bristles adjacent the central portion is shorter in length than the remaining rows of bristles.

Thus, the advantage of the present invention is an artificial nail and polish remover that is comfortably and securely handled and which permits simultaneous scuffing of all the fingernails or individual scuffing of just one fingernail. The device is simple and inexpensive in design, yet reliably constructed. The arrangement of bristles is securely maintained within the device to provide simultaneous uniform scuffing action to all the fingernails. Furthermore, the present invention provides ample finger support so that the device may be easily and comfortably used to remove fingernail polish and artificial fingernails from a wide range of different size hands.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF THE INVENTION

Figure 1:
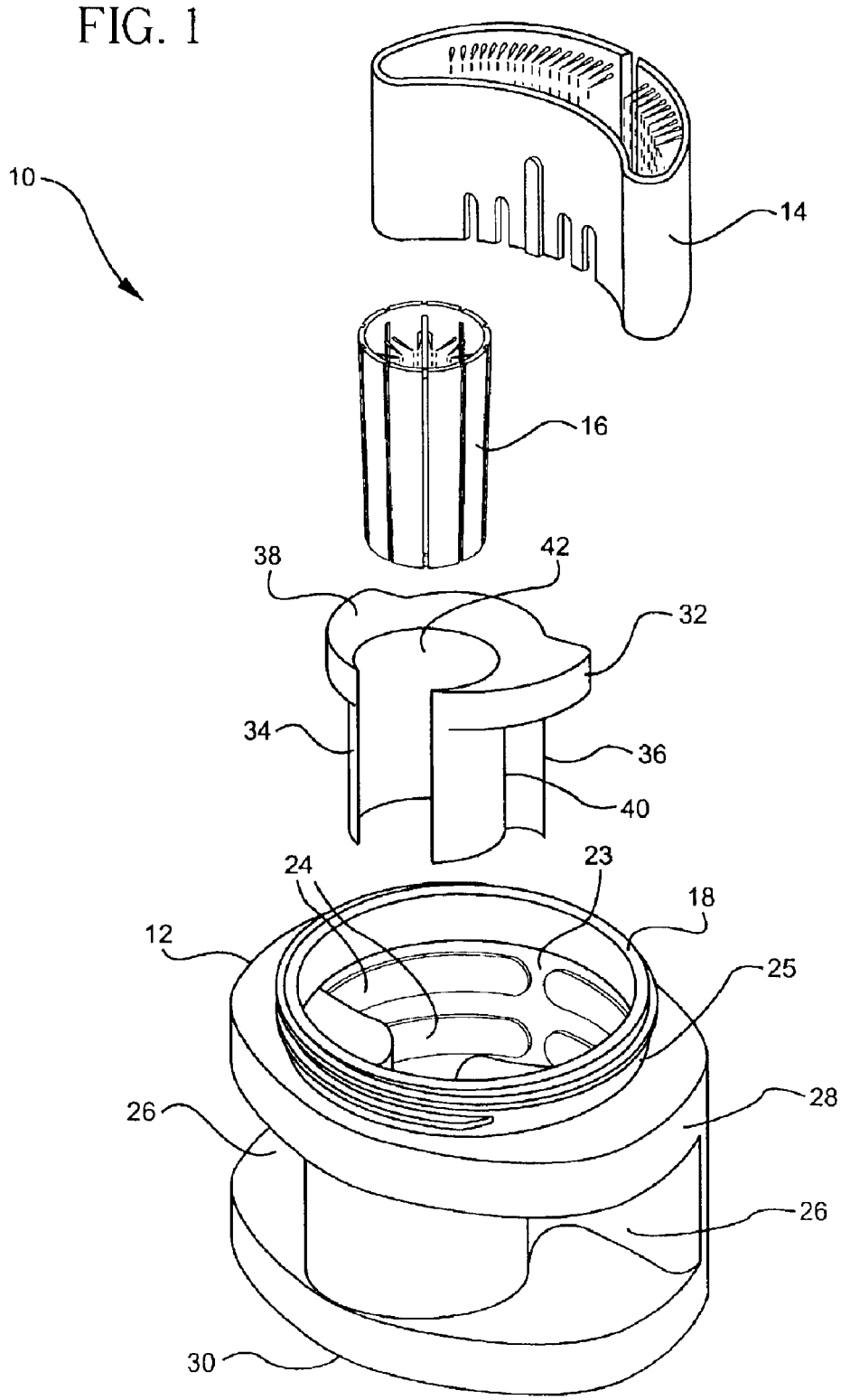
FIG. 1 is an exploded perspective view of the artificial nail and polish remover formed in accordance with the present invention.
Figure 2:
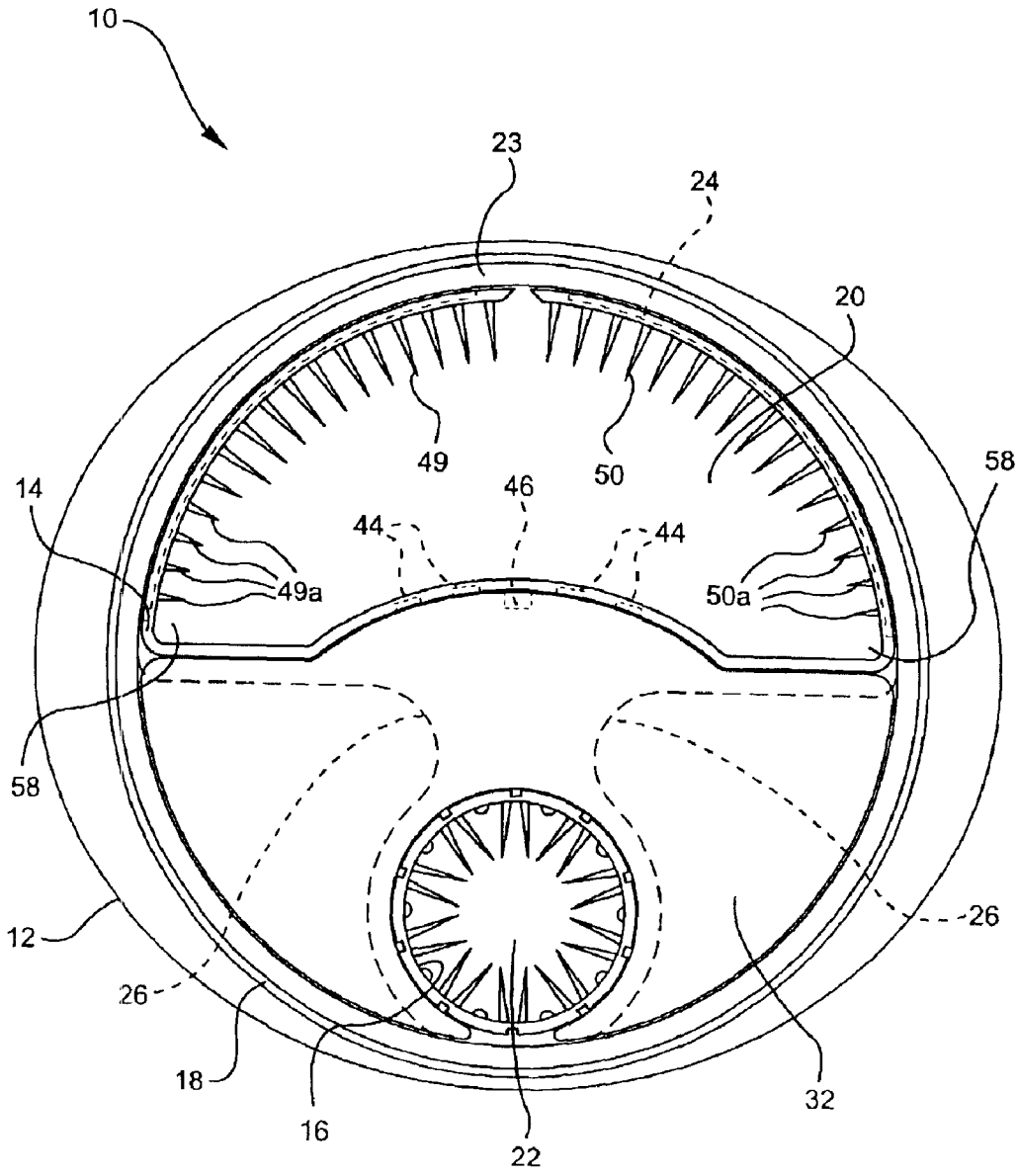
FIG. 2 is a top view of the artificial nail and polish remover shown in FIG. 1.
Figure 3:
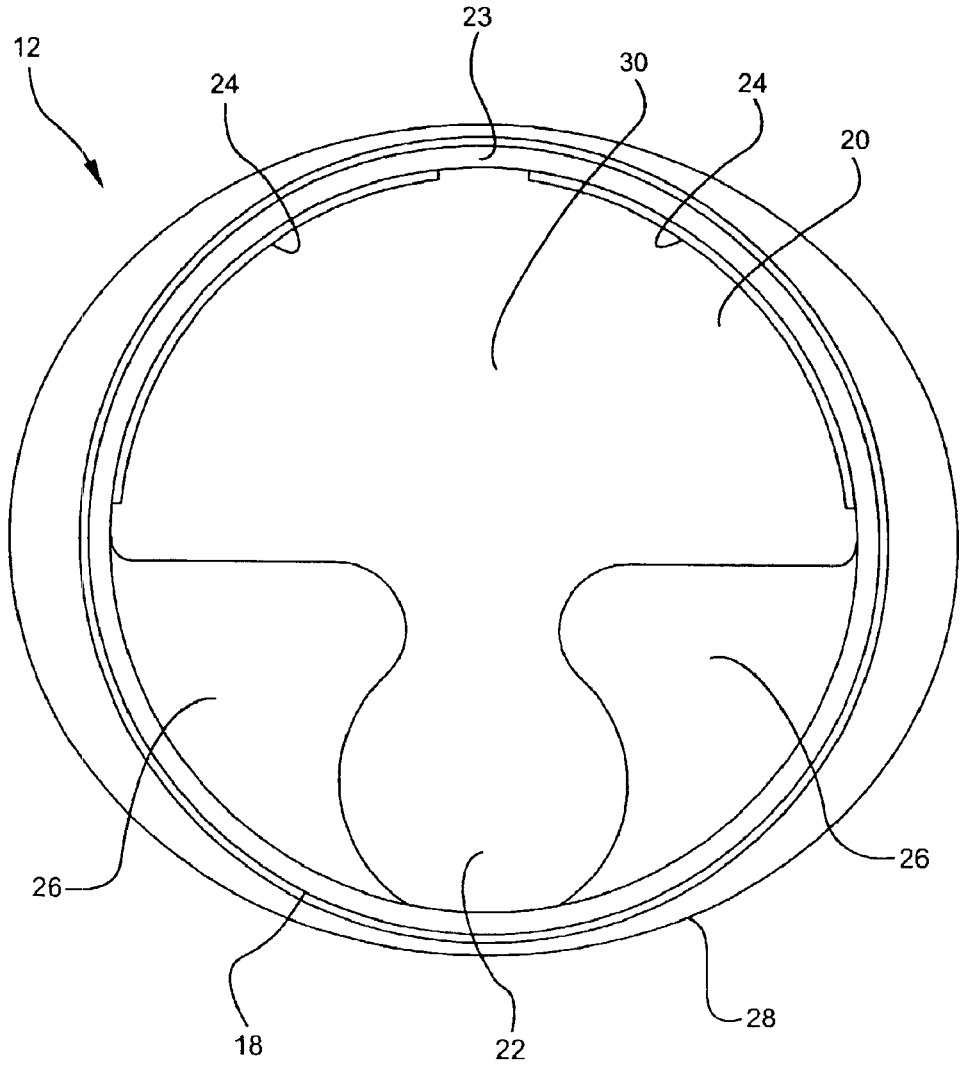
FIG. 3 is a top view of the container of the artificial nail and polish remover shown in FIG. 1.

Referring to FIGS. 1 and 2, the artificial nail and polish remover 10 of the present invention generally includes a container 12, a strip brush 14 and a tubular brush 16. Referring additionally to FIG. 3, the container 12 is generally circular and includes an open top 18 for introducing and holding a liquid solvent, such as acetone, for dissolving artificial fingernails and/or fingernail polish.

The container 12, which can be molded from a durable shatter-resistant plastic material chemically resistant to liquid solvent, is configured to define a semi-circular receptacle 20 for insertion of the fore-fingers and a circular receptacle 22 for insertion of the thumb through the top of the container. Preferably, the semi-circular receptacle 20 is in fluid communication with the circular receptacle 22 so that the liquid solvent can flow between the receptacles. The container 12 is designed for either simultaneous insertion of all of the fingers of a hand or individual insertion of a finger into the circular receptacle 22. More particularly, the semi-circular receptacle 20 is sized and shaped for simultaneous insertion therein of the fore-fingers of a hand and the circular receptacle 22 is positioned adjacent the semi-circular receptacle whereby the thumb of a user of the remover can be inserted simultaneously with the fore-fingers.

Formed on the interior of the outer wall 23 of the semi-circular receptacle 20 are four elongate projections 24 which, as will be discussed in further detail below, engage correspondingly sized shallow grooves 64 formed in the strip brush member 14 to secure the strip brush member in the container 12. Additionally, the opening 18 of the container 12 can be provided with external threads 25 which engage internal threads of a container cap (not shown) for securing the cap to the container when not in use.

The container 12 can be further provided with two depressions or indents 26 formed in the outer circumferential wall 28 of the container around the circular receptacle 22 between the top 18 and the bottom 30 of the container. The depressions 26 extend inwardly into the interior of the container 12 thereby partially defining the semi-circular receptacle 20 and the circular receptacle 22. The depressions 26 further provide a secure finger grip to the container 12 for the opposite hand of the user not inserted into the container.

Figure 4:
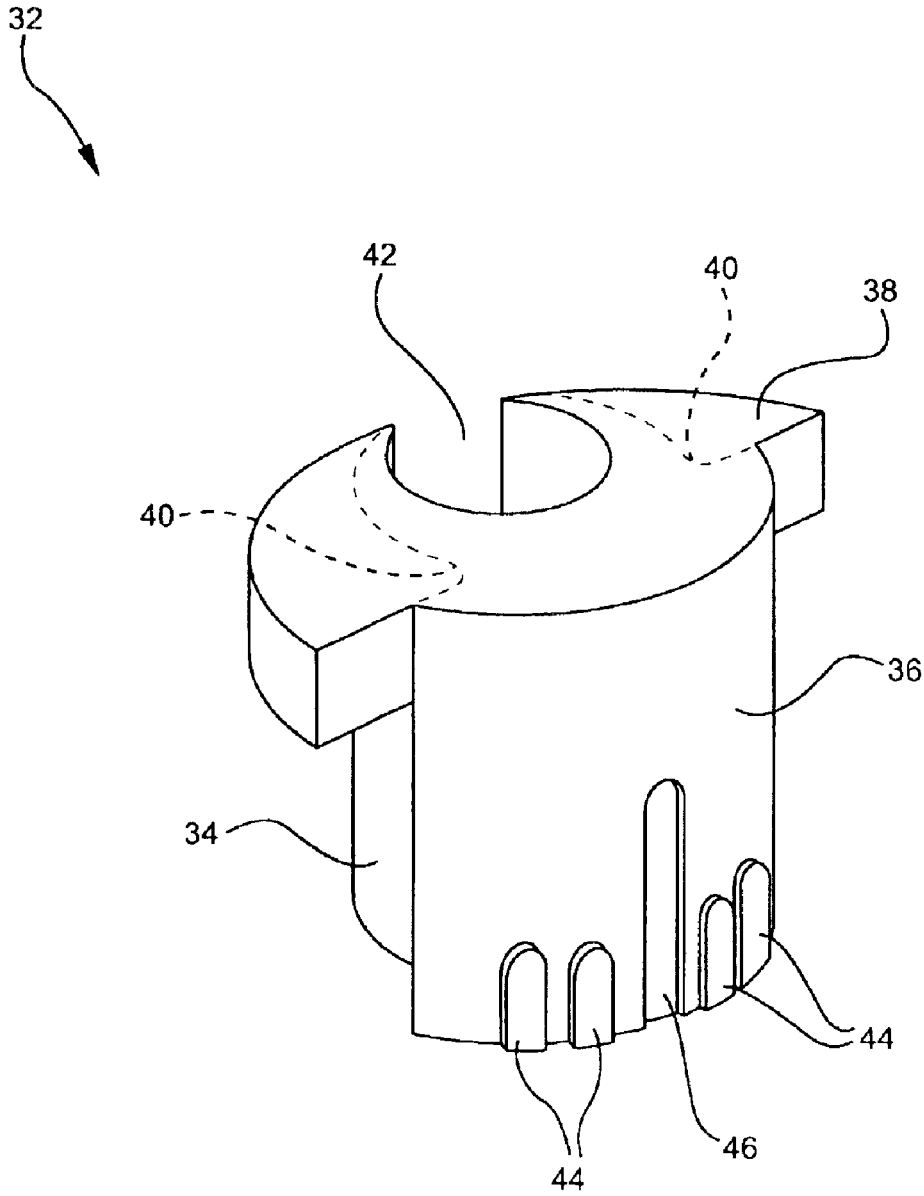
FIG. 4 is a perspective view of the finger support side of the container insert shown in FIG. 1.

Referring now to FIGS. 1 and 4, in a preferred embodiment, the container 12 includes an insert 32 having a tubular portion 34, a finger support portion 36 and a shoulder portion 38. The insert 32 can be molded from a similar solvent resistant material as that of the container 12. The tubular portion 34 of the insert 32 is separated from the finger support portion 36 by insert depressions or indents 40 that correspond in size and shape to the depressions 26 formed in the container 12. The tubular portion 34 has an outer diameter slightly less than the inner diameter of the circular receptacle 22 so that the tubular portion slides snugly into the circular receptacle. The tubular portion further includes an inner cylindrical bore 42 sized to snugly receive the tubular brush 16. When the insert 32 is seated in the container 12, the finger support portion 36 extends into the semi-circular receptacle 20 and the shoulder portion 38 rests on the depressions 26 formed in the container. Thus, with the insert 32 seated in the container 12, the inner cylindrical bore 42 of the insert 32 defines the circular receptacle 22 of the device 10 and the finger support portion 36, along with the continuous side wall 23 of the container, defines the semi-circular receptacle 20.

Additionally, formed near the bottom edge of the finger support portion 36 are four ribs or projections 44 and a shallow groove 46 which, as will be discussed in further detail below, engage correspondingly sized notches 60 and a rib projection 62 formed in the strip brush member 14 to secure the strip brush member in the semi-circular receptacle 20 of the container 12 during scuffing. Furthermore, the overall length of the insert 32, from the top of the shoulder portion 38 to the bottom of the finger support portion 36, is preferably less than the depth of the container 12 so that the semi-circular receptacle 20 remains in fluid communication with the circular receptacle 22 defined by the inner cylindrical bore 42 of the insert. In other words, when seated in the container 12, the insert 32 does not extend to the bottom 30 of the container, thereby leaving a fluid path for solvent to flow between the receptacles 20 and 22.

Disposed around the perimeter walls of the semi-circular receptacle 20 is the strip brush member 14 and disposed within the circular receptacle 22 is the tubular brush 16. As described above, in the preferred embodiment, the semi-circular receptacle 20 is defined by the container wall 23 and the finger support portion 36 of the insert 32 while the circular receptacle 22 is defined by the cylindrical bore 42 of the insert. Thus, the strip brush member 14 would be circularly disposed between the container wall 23 and the finger support portion 36 of the insert 32 while the tubular brush 16 would be disposed within the cylindrical bore 42 of the insert. Alternatively, the container 12 can be formed to integrally define the semi-circular receptacle 20 and the circular receptacle 22 without the use of the insert 32. In this alternative embodiment, the strip brush member 14 would be circularly disposed within the semi-circular receptacle 20, defined by the container 12 itself, while the tubular brush 16 would be disposed within the circular receptacle 20 defined by the container.

The strip brush member 14 and the tubular brush 16 are preferably molded from a durable yet flexible plastic material that is chemically resistant to liquid solvent. The strip brush member 14 engages the fingernails of the fore-fingers inserted in the semi-circular receptacle 20 and the tubular brush 16 engages the fingernail of the thumb, or an individual fore-finger, inserted into the circular receptacle 22. The brushes 14 and 16 are utilized for scuffing the fingernails to loosen and remove artificial fingernails and/or polish.

Figure 5:
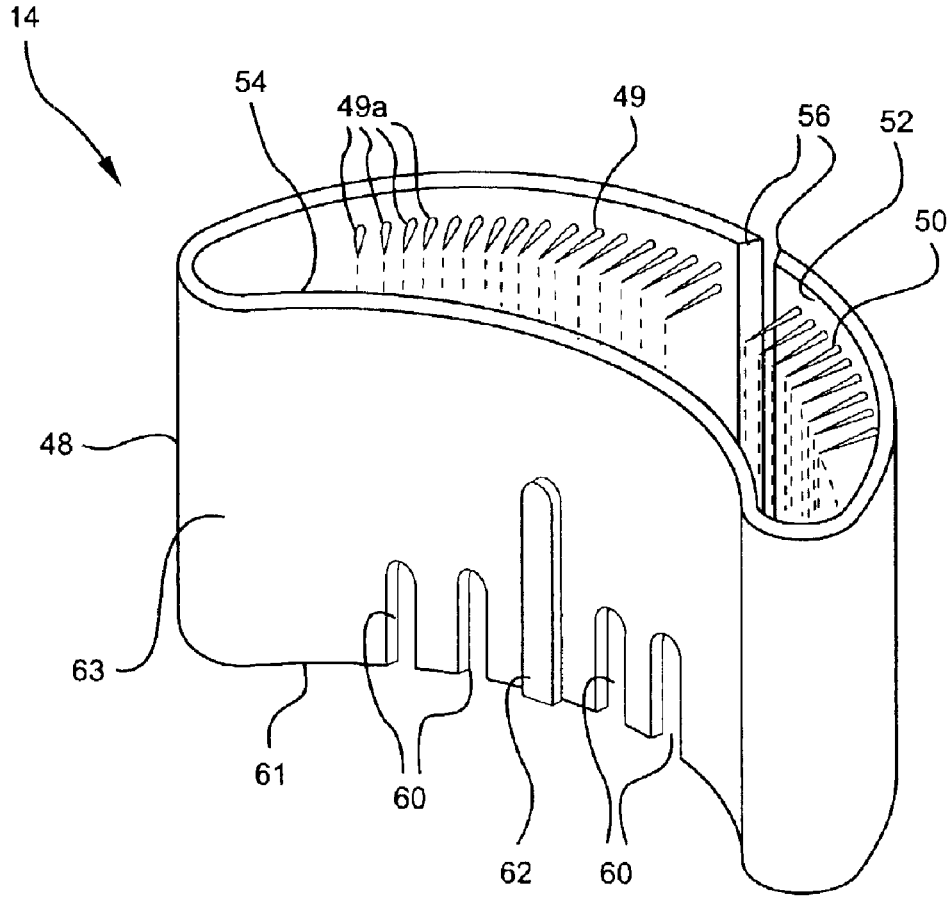
FIG. 5 is a perspective view of the strip brush member shown in FIG. 1.
Figure 6:
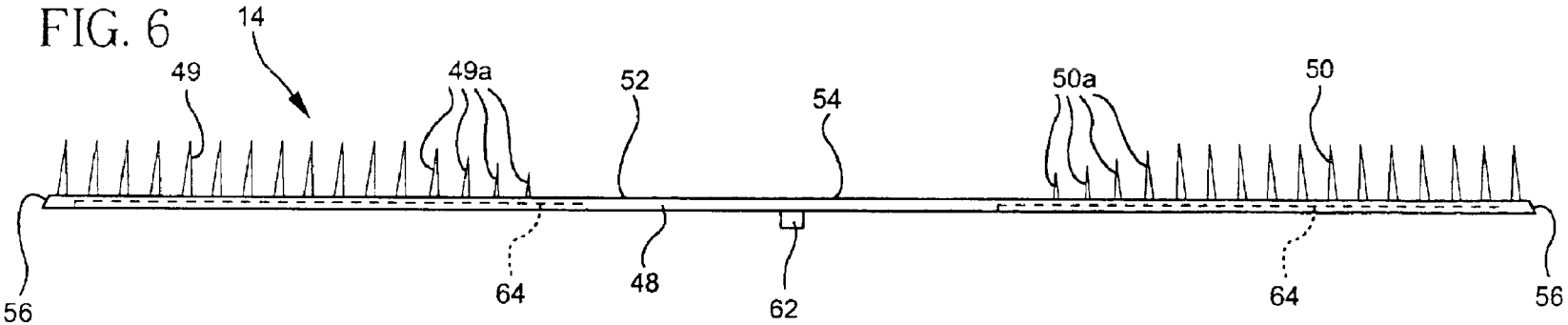
FIG. 6 is a side view of an uncoiled strip brush member.
Figure 7:
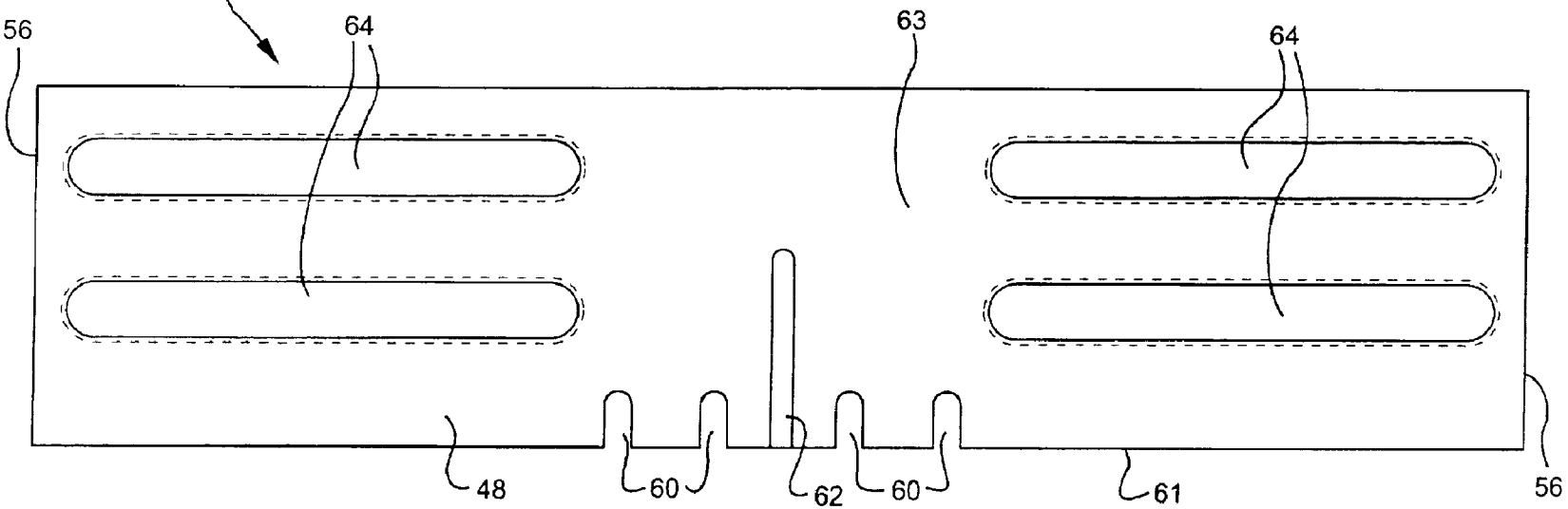
FIG. 7 is a back plan view of an uncoiled strip brush member.

Referring additionally to FIGS. 5–7, the strip brush member 14 includes a flat backing member 48 which is coiled around the entire perimeter of the semi-circular receptacle 20. The strip backing member 48 includes two sets of integrally formed bristles 49 and 50 projecting from an inside face 52 thereof and a central portion 54 separating the two sets of bristles. The bristles 49 and 50 in each set are positioned in parallel rows from the central portion 54 outwardly to the opposite ends 56 of the strip 48. In a preferred embodiment, at least the first row of bristles 49 and 50 adjacent the central portion 54 is shorter in length than the remaining rows. More preferably, the first few rows of bristles 49*a* and 50*a* increase in height from the central portion 54 outwardly to a maximum height of about 7 mm. The remaining rows of bristles 49 and 50 are a uniform height of about 9 mm. The reason for the shorter lengths of the first several rows of bristles 49*a* and 50*a* is to maintain substantially constant clearance for the fingernails in the reduced-clearance corners 58 of the semi-circular receptacle 20 where the curvature of the outer wall 23 meets the indents 26 of the container 12, as shown in FIG. 2. The shorter length bristles 49*a* and 50*a* are positioned in these corners 58. Thus, uniform scuffing can be achieved throughout the entire semi-circular receptacle 20.

The strip backing member 48 is coiled around the perimeter of the semi-circular receptacle 20 so that the ends 56 of the strip meet at the top of the receptacle wall 23 and the bristles 49 and 50 are positioned opposite the central portion 54. The strip 48 further includes four notches 60 formed on a bottom edge 61 of the central portion 54, a narrow rib projection 62 projecting from an outside face 63 of the central portion and two shallow grooves 64 formed on the outside face of the strip opposite each set of bristles 49 and 50. As mentioned above, the notches 60 and the rib 62 respectively engage the projections 44 and the shallow groove 46 formed on the finger support portion 36 of the insert 32 and the strip grooves 64 engage the elongate projections 24 formed on the outer wall 23 of the semi-circular receptacle 20 to prevent movement of the brush while the fingernails are being scuffed thereagainst.

Figure 8:
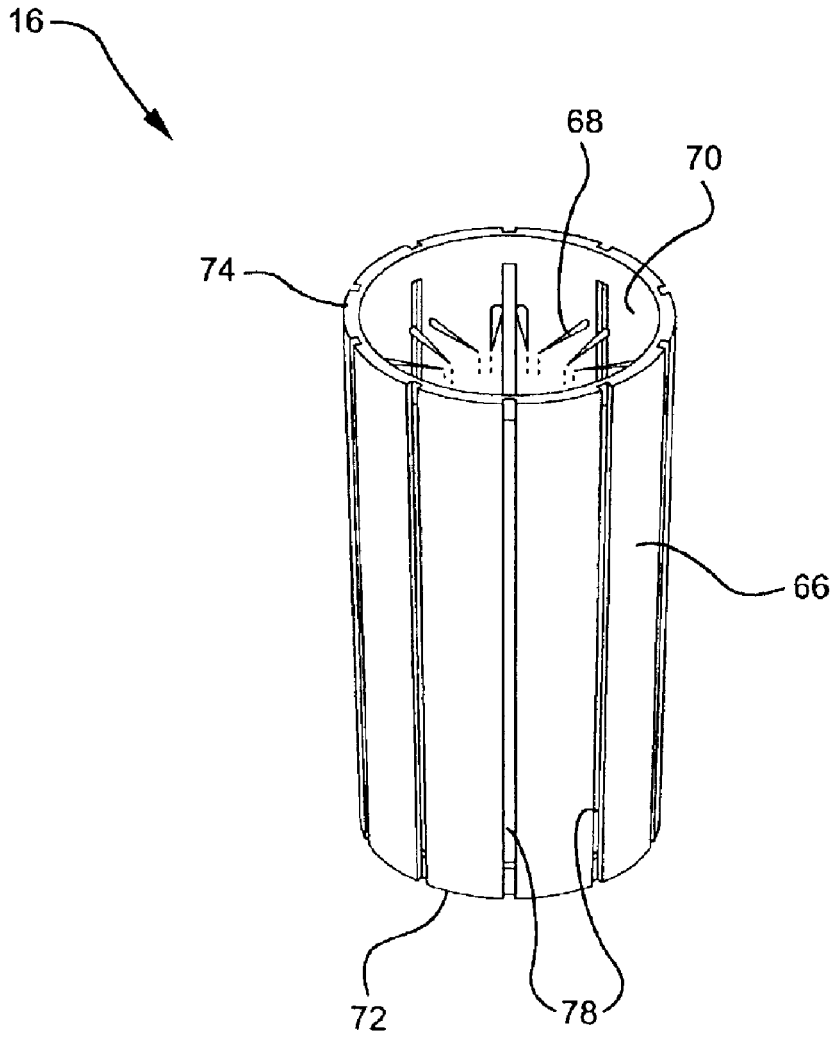
FIG. 8 is a perspective view of the tubular brush shown in FIG. 1.
Figure 9:
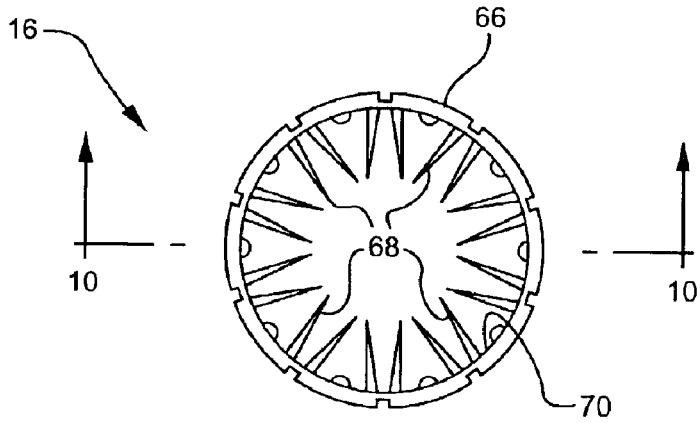
FIG. 9 is a top plan view of the tubular brush shown in FIG. 8.
Figure 10:
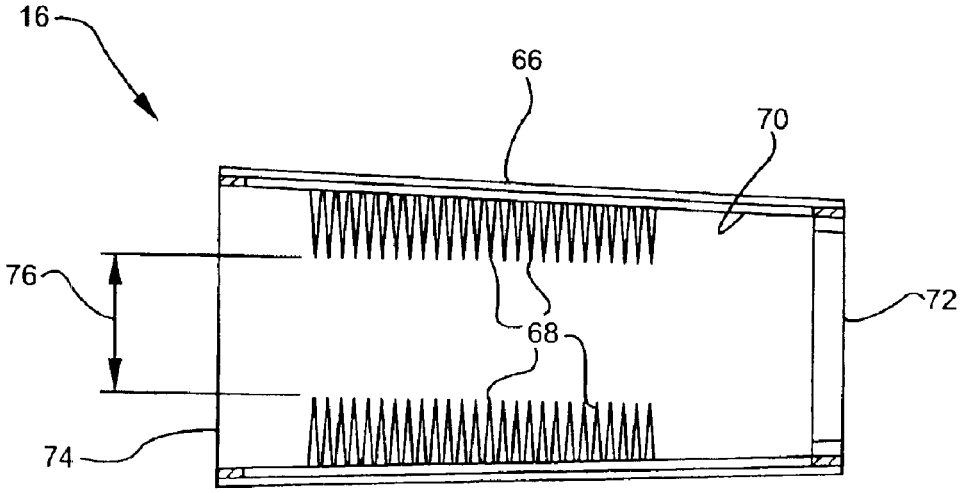
FIG. 10 is a cross-sectional view of the tubular brush shown in FIG. 9 taken along the line 10—10.

Referring additionally now to FIGS. 8–10, the circular receptacle 22 contains the tubular brush 16 therein. The tubular brush 16 is a contiguous cylinder 66 having integrally formed and substantially uniform length bristles 68 projecting inwardly from the inner radial surface 70 thereof. Preferably, the diameter of the cylinder 66 is chosen so that the tubular brush 16 is fixed within the circular receptacle 22 of the container 12 by friction. In this manner there is no structure required in the circular receptacle 22 for retaining the tubular brush 16. The cylinder 66 is also preferably tapered, i.e., the diameter of one end 72 of the tube is less than the diameter of the opposite end 74, to improve the friction fit within the circular receptacle 22. In other words, the taper of the cylinder 66 provides a biasing force to the brush 16 that ensures a secure fit of the brush within the circular receptacle.

Because the cylinder 66 is preferably slightly tapered, the bristles 68 slightly increase in height from the narrower end 72 of the cylinder to the wider end 74 so that the inner diameter 76 between opposite bristles remains constant. The cylinder 66 further preferably includes a plurality of slits 78 formed therethrough which allow the solvent to flow into and out of the interior of the brush 16.

In use, a person wishing to remove nail polish, or one or more artificial nails, from the natural fingernails, first removes the container cap and then inserts an individual finger in the circular receptacle 22 and/or several fore-fingers in the semi-circular receptacle 20. With a firm grip of the opposite hand on the depressions 26 of the container 12, the container and/or the fingers in the container are rotated with respect to the brush bristles 49, 50 and/or 68 to scuff the fingernails. The combination of the scuffing action and the dissolving reaction of the solvent in the container 12 will cause the polish and/or the artificial nails to be easily removed from the natural nails. The remnant polish and/or artificial nails will fall to the bottom of the container 12 and the device 10 can be reused multiple times until the solvent is no longer effective or the bristles 49, 50 and 68 become worn. Because of its simple construction, it is anticipated that the cost to the consumer to replace the device will be relatively small.

As a result of the present invention, an artificial nail and polish remover is provided which permits simultaneous scuffing of all the fingernails or individual scuffing of just one fingernail. The device is simple in design and inexpensive to construct. Furthermore, the present invention is easily and comfortably used to remove fingernail polish and artificial fingernails from a wide range of different size hands.

While there has been described what is presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A device for removing artificial fingernails and fingernail polish comprising:

a container having a bottom, a continuous side wall and a top, said container defining a semi-circular receptacle opening at said top and a circular receptacle opening at said top, said semi-circular receptacle opening being sized and shaped for simultaneous insertion therein of the fore-fingers of a hand and said circular receptacle opening being positioned adjacent said semi-circular receptacle opening whereby the thumb of a user of said remover can be inserted simultaneously with said fore-fingers;

a strip brush member having a plurality of bristles, said strip brush member being fixed around an inside perimeter wall of said semi-circular receptacle opening, whereby said bristles project inwardly into said semi-circular receptacle opening for scuffing the nails of the fore-fingers; and a tubular brush having a plurality of bristles, said tubular brush being fixed within said circular receptacle opening, whereby said bristles project inwardly into said circular receptacle opening for scuffing the thumbnail.

2. A device as defined in claim 1, wherein said strip brush member comprises a front face and a back face, said bristles projecting from said front face and said back face having at least one groove formed thereon, and wherein said inside perimeter wall includes a projection formed thereon for engaging said groove, whereby said strip brush member is fixed against movement during scuffing.

3. A device as defined in claim 1, wherein said tubular brush comprises a cylinder having a wall with a plurality of slits formed therethrough, whereby solvent flows into and out of the interior of said tubular brush.

4. A device as defined in claim 1, wherein said side wall comprises two depressions formed therein, whereby a secure grip can be made of said container by the non-inserted hand of said user.

5. A device as defined in claim 4, wherein said depressions extend inwardly into said container, thereby partially defining said semi-circular receptacle opening and said circular receptacle opening.

6. A device as defined in claim 1, wherein said semi-circular receptacle opening is in fluid communication with said circular receptacle opening.

7. A device for removing artificial fingernails and fingernail polish comprising:

a container having a bottom, a continuous side wall and a top, said container defining a semi-circular receptacle opening at said top and a circular receptacle opening at said top, said semi-circular receptacle opening being sized and shaped for simultaneous insertion therein of the fore-fingers of a hand and said circular receptacle opening being positioned adjacent said semi-circular receptacle opening whereby the thumb of a user of said remover can be inserted simultaneously with said fore-fingers; and an insert fitted into said container, said insert having a tubular portion and a finger support portion, said tubular portion including a cylindrical bore defining said circular receptacle opening and said finger support portion, along with said continuous side wall of said container, defining said semi-circular receptacle opening.

8. A device as defined in claim 7, further comprising:

a strip brush member having a plurality of bristles, said strip brush member being fixed around an inside perimeter wall of said semi-circular receptacle opening, whereby said bristles project inwardly into said semi-circular receptacle opening for scuffing the nails of the fore-fingers; and a tubular brush having a plurality of bristles, said tubular brush being fixed within said cylindrical bore of said insert, whereby said bristles project inwardly into said circular receptacle opening for scuffing the thumbnail.

9. A device as defined in claim 8, wherein said strip brush member comprises a front face and a back face, said bristles projecting from said front face and said back face having at least one notch formed thereon, and wherein said finger support portion of said insert includes a projection formed thereon for engaging with said notch, whereby said strip brush member is fixed against movement during scuffing.

10. A device as defined in claim 8, wherein said strip brush member comprises a front face and a back face, said bristles projecting from said front face and said back face having at least one projection formed thereon, and wherein said finger support portion of said insert includes a groove formed therein for engaging with said projection, whereby said strip brush member is fixed against movement during scuffing.

11. A device as defined in claim 8, wherein said strip brush member comprises a front face, a back face, two sets of bristles projecting from said front face and a central portion separating said two sets of bristles, said back face of said strip brush member adjacent said central portion being positioned against said finger support portion of said insert.

12. A device as defined in claim 11, wherein said bristles extend in substantially parallel rows from said central portion outwardly to opposite ends of said strip brush member, at least the first row of bristles adjacent the central portion being shorter in length than the remaining rows of bristles.

13. A device as defined in claim 8, wherein said tubular brush comprises a cylinder having a wall with a plurality of slits formed therethrough, whereby solvent flows into and out of the interior of said tubular brush.

14. A device for removing artificial fingernails and fingernail polish comprising:

a container having a bottom, a continuous side wall and a top, said container defining a semi-circular receptacle opening at said top and a circular receptacle opening at said top, said semi-circular receptacle opening being sized and shaped for simultaneous insertion therein of the fore-fingers of a hand and said circular receptacle opening being positioned adjacent said semi-circular receptacle opening whereby the thumb of a user of said remover can be inserted simultaneously with said fore-fingers; and an insert fitted into said container, said insert comprising:

a tubular portion including a cylindrical bore defining said circular receptacle opening;

a finger support portion separated from said tubular portion by two insert depressions corresponding in shape to said depressions formed in said container, said finger support portion, along with said continuous side wall of said container, defining said semi-circular receptacle opening; and a shoulder portion connecting said tubular portion and said finger support portion; said shoulder portion resting on said container depressions.

15. A device as defined in claim 14, further comprising:

a strip brush member having a plurality of bristles, said strip brush member being fixed around an inside perimeter wall of said semi-circular receptacle opening, whereby said bristles project inwardly into said semi-circular receptacle opening for scuffing the nails of the fore-fingers; and a tubular brush having a plurality of bristles, said tubular brush being fixed within said cylindrical bore of said insert, whereby said bristles project inwardly into said circular receptacle opening for scuffing the thumbnail.

16. A device as defined in claim 15, wherein said strip brush member comprises a front face and a back face, said bristles projecting from said front face and said back face having at least one notch formed thereon, and wherein said finger support portion of said insert includes a projection formed thereon for engaging with said notch, whereby said strip brush member is fixed against movement during scuffing.

17. A device as defined in claim 15, wherein said strip brush member comprises a front face and a back face, said bristles projecting from said front face and said back face having at least one projection formed thereon, and wherein said finger support portion of said insert includes a groove formed therein for engaging with said projection, whereby said strip brush member is fixed against movement during scuffing.

18. A device as defined in claim 15, wherein said strip brush member comprises a front face, a back face, two sets of bristles projecting from said front face and a central portion separating said two sets of bristles, said back face of said strip brush member adjacent said central portion being positioned against said finger support portion of said insert.

19. A device as defined in claim 18, wherein said bristles extend in substantially parallel rows from said central portion outwardly to opposite ends of said strip brush member, at least the first row of bristles adjacent the central portion being shorter in length than the remaining rows of bristles.

20. A device as defined in claim 15, wherein said tubular brush comprises a cylinder having a wall with a plurality of slits formed therethrough, whereby solvent flows into and out of the interior of said tubular brush.

* * * * *